US010426223B2

(12) United States Patent
Lucca

(10) Patent No.: US 10,426,223 B2
(45) Date of Patent: Oct. 1, 2019

(54) THREE LAYER SHOE CONSTRUCTION WITH IMPROVED CUSHIONING AND FLEXIBILITY

(71) Applicant: Footwear Unlimited Inc., Fenton, MO (US)

(72) Inventor: Fabio Lucca, Valley Park, MO (US)

(73) Assignee: Footwear Unlimited Inc., Fenton, MO (US)

( * ) Notice: Subject to any disclaimer, the term of this patent is extended or adjusted under 35 U.S.C. 154(b) by 245 days.

(21) Appl. No.: 15/658,632

(22) Filed: Jul. 25, 2017

(65) Prior Publication Data

US 2019/0029365 A1 Jan. 31, 2019

(51) Int. Cl.

| | |
|---|---|
| ***A43B 5/00*** | (2006.01) |
| ***A43B 13/00*** | (2006.01) |
| ***A43B 13/14*** | (2006.01) |
| ***A43B 13/12*** | (2006.01) |
| ***A43B 7/14*** | (2006.01) |
| ***A43B 13/18*** | (2006.01) |
| ***A43B 1/00*** | (2006.01) |
| ***A43B 13/04*** | (2006.01) |

(52) U.S. Cl.

CPC ..... *A43B 13/186* (2013.01); *A43B 1/0045* (2013.01); *A43B 7/142* (2013.01); *A43B 13/04* (2013.01); *A43B 13/122* (2013.01); *A43B 13/125* (2013.01); *A43B 13/141* (2013.01); *A43B 13/188* (2013.01)

(58) Field of Classification Search

CPC ..... A43B 13/189; A43B 13/04; A43B 13/122; A43B 13/125; A43B 13/141; A43B 13/188; A43B 13/38; A43B 13/40; A43B 1/0045; A43B 7/141; A43B 7/142

USPC ..... 36/28, 25 R, 30 R, 88

See application file for complete search history.

(56) References Cited

U.S. PATENT DOCUMENTS

| | | | | |
|---|---|---|---|---|
| 1,568,064 A | | 1/1926 | Goldman | |
| 4,641,438 A | | 2/1987 | Laird et al. | |
| 4,794,707 A | | 1/1989 | Franklin et al. | |
| 4,866,861 A | | 9/1989 | Noone | |
| 4,942,679 A | | 7/1990 | Brandon et al. | |
| 5,224,277 A | | 7/1993 | Sang Do | |
| 5,353,526 A | | 10/1994 | Foley et al. | |
| 5,400,526 A | * | 3/1995 | Sessa | A43B 1/0045 36/141 |
| 6,038,790 A | | 3/2000 | Pyle et al. | |

(Continued)

*Primary Examiner* — Jameson D Collier
(74) *Attorney, Agent, or Firm* — Husch Blackwell LLP

(57) ABSTRACT

A three-layered shoe construction having an outsole with a first section located in the arch portion and extending into and towards the medial side of both the forefoot and hind foot areas, and a second section located in the remainder of the outsole, the first section including a plurality of horizontal grooves, the second section including a plurality of small and elongated apertures, the outsole having a first cavity on its interior face; a dual-density midsole having a first density in the forefoot area and a second density in the hind foot area, the second density being greater than the first density, the midsole having a second cavity on its proximal face; and an insole having a top face including a plurality of raised projections, the outer perimeter and medial half of the arch portion being smooth. The specific construction associated with the three-layered shoe enhances flexibility, cushioning, and breathability.

19 Claims, 6 Drawing Sheets

(56) References Cited

U.S. PATENT DOCUMENTS

| | | | | |
|---|---|---|---|---|
| 6,061,929 | A | 5/2000 | Ritter | |
| 6,161,315 | A | 12/2000 | Dalton | |
| 6,276,073 | B1 | 8/2001 | Curley, Jr. | |
| 6,705,027 | B1 | 3/2004 | Campbell | |
| 6,817,117 | B1 | 11/2004 | Campbell | |
| 6,857,202 | B2 * | 2/2005 | Pfander | A43B 1/0009 36/28 |
| 7,610,695 | B2 | 11/2009 | Hay | |
| 7,637,034 | B2 | 12/2009 | Ailey et al. | |
| 10,231,512 | B2 * | 3/2019 | Lucca | A43B 1/0045 |
| 10,231,513 | B1 * | 3/2019 | Lucca | A43B 7/142 |
| 10,238,174 | B2 * | 3/2019 | Lucca | A43B 17/00 |
| 2002/0004999 | A1 | 1/2002 | Caine et al. | |
| 2002/0078598 | A1 | 6/2002 | Bell | |
| 2004/0103559 | A1 * | 6/2004 | Pfander | A43B 7/144 36/44 |
| 2005/0268490 | A1 * | 12/2005 | Foxen | A43B 7/1425 36/28 |
| 2007/0277401 | A1 | 12/2007 | Young-Chul | |
| 2009/0090031 | A1 | 4/2009 | Jung | |
| 2009/0188131 | A1 | 7/2009 | Doerer et al. | |
| 2009/0307932 | A1 | 12/2009 | Kirby et al. | |

* cited by examiner

THREE LAYER SHOE CONSTRUCTION WITH IMPROVED CUSHIONING AND FLEXIBILITY

FIELD OF THE INVENTION

The present invention relates to a shoe construction and, more particularly, to a three layered shoe construction with an outsole having a unique exterior face pattern to enhance flexibility and comfort, a dual density midsole, and an insole having a distinctive bubble type pattern for increased breathability, air circulation, and comfort coupled with a raised arch area for providing additional support to the arch of the foot.

BACKGROUND OF THE INVENTION

Numerous shoes, covering a broad range of different designs and styles have been manufactured and sold in the marketplace. While shoes are worn to provide protection to one's feet, to reduce the impact felt when walking on hard surfaces, to provide support for the feet, and to prevent pronation, shoe designers must still seek to provide optimum levels of stability and comfort. In order to accomplish all of these objectives, shoe designers have used a wide variety of different tools and methods including heel plugs, shanks, contoured soles, deformable pillars or columns, spring-like structures, different traction designs, cushioning members, different shank designs, different ventilation structures, rocker elements, pads, gels and sole constructions having a plurality of different layers. Although these methods can be effective, the large number of components can result in increased manufacturing costs and complexity. It is therefore desirable to improve cushioning, flexibility, support and stability without increasing the number of components to achieve the same level of comfort for the user.

SUMMARY OF THE INVENTION

The present invention is directed to a three layer shoe construction which includes an outsole, midsole, and insole. The three layers have a mating relationship which will be later described in detail. The three components of the present shoe are preferably secured together through conventional means such as through cementing and/or adhesives thereby preventing relative movement between the layers during assembly and use of the present shoe. Each of the three layers of the present shoe are generally in the shape of a human foot and can be divided into different sections according to the three different regions of the human foot—the forefoot, the midfoot, and the hind foot. The forefoot is generally adjacent to and includes the toe area; the hind foot is generally adjacent to and includes the heel area; and the midfoot is located adjacent to both the forefoot and the hind foot. The ball of the foot is generally the area of the foot at the juncture between the metatarsal bones and the phalange bones. The two primary regions of the foot for load bearing when walking or standing normally are the ball area and the heel area, and the major bending of the shoe during normal use is typically in the ball area. The arch or instep is positioned between the heel and ball areas and flexes very little when walking normally.

The present outsole is made out of a super lightweight thermoplastic rubber (TPR) and includes an exterior and interior face. The exterior face of the present outsole engages the ground or other walking surfaces, while the interior face is located opposite the exterior face and has a mating relationship with the midsole as will be hereinafter further described in more detail.

The exterior face of the outsole includes a first and second section. The first section includes parts of the midfoot, forefoot, and hind foot areas respectively. In one embodiment, the first section includes the arch portion and extends from the arch portion towards the proximal side of the forefoot area and also extends in an opposite direction towards the proximal side of the hind foot area, the proximal side being a medial side. The first section further includes a plurality of horizontal grooves to provide extra flexibility and comfort in the first section and is divided from the second section by a non-linear groove. The second section, on the other hand, includes the reminder of the outsole. More specifically, the second section includes the majority of the forefoot and hind foot area and the portion of the midfoot area that is adjacent to the arch portion. The second section includes a plurality of small and elongated apertures which also provide the wearer with additional flexibility and comfort. In one embodiment, this same pattern of small and elongated apertures are located and positioned in spaced apart relationship to each other along the longitudinal axis of the outsole. The second section also provides for additional flexibility and comfort to the wearer.

The interior face of the outsole includes a lip surrounding its circumference thereby creating a first cavity substantially in the same shape as the outsole. The outsole has a mating relationship with the midsole, which will be hereinafter further explained. The remainder of the interior face of the outsole is substantially smooth.

The present midsole is made of a dual density blown ethylene-vinyl acetate copolymer (EVA) with an intrinsic molded arch support which supports the arch of the foot. The EVA creates a lightweight and resilient midsole which helps dissipate shock when walking or running. In addition to the material itself, the dual density of the midsole allows for greater flexibility and cushioning in the forefoot area due to its lighter density, and provides greater support and stability in the hind foot area due to its heavier density. The sidewall of the midsole is substantially smooth.

The midsole has a proximal and distal face. The distal face includes a protrusion or raised area substantially in the shape of the outsole and corresponds to the shape of the first cavity in the outsole. The midsole has a mating relationship with the outsole wherein the distal face of the midsole mates with and is received by the first cavity created by the lip on the interior face of the outsole. The insole also has a mating relationship to the midsole wherein the proximal face of the midsole has a lip or flange extending around its entire circumference creating a second cavity substantially in the shape of the insole. The insole mates with and is received by the second cavity of the midsole. The three layers are preferably secured together to prevent movement when worn.

The insole is a lightweight, thermal molded EVA with a molded arch for additional arch support and an antimicrobial shield which provides protection against bacteria, fungus, and controls or eliminates odors, stains, and product deterioration. This can be accomplished by adding a powder or other antimicrobial agents during the manufacturing process. The insole has a top face and a bottom face wherein the top face engages with the foot of a wearer and has a plurality of raised hexagonal shaped projections that provide for a bubble type effect which enhances cushioning and air circulation when the shoe is worn. In one embodiment, the raised hexagon projections cover the entire top face of the insole except for the outer perimeter of the insole and approximately the proximal half of the arch portion (the proximal half being a medial half). The hexagonal shaped projections create a distinctive bubble type pattern. The proximal half of the arch portion is smooth except for a U-shaped groove which follows the curve of the arch portion. The bottom face of the insole is smooth.

The present three layer shoe construction absorbs shock, enhances comfort, and creates a unique propulsion effect, without requiring a vast number of components.

BRIEF DESCRIPTION OF THE DRAWINGS

For a better understanding of the various embodiments of the present invention, reference may be made to the accompanying drawings in which.

Figure 1:
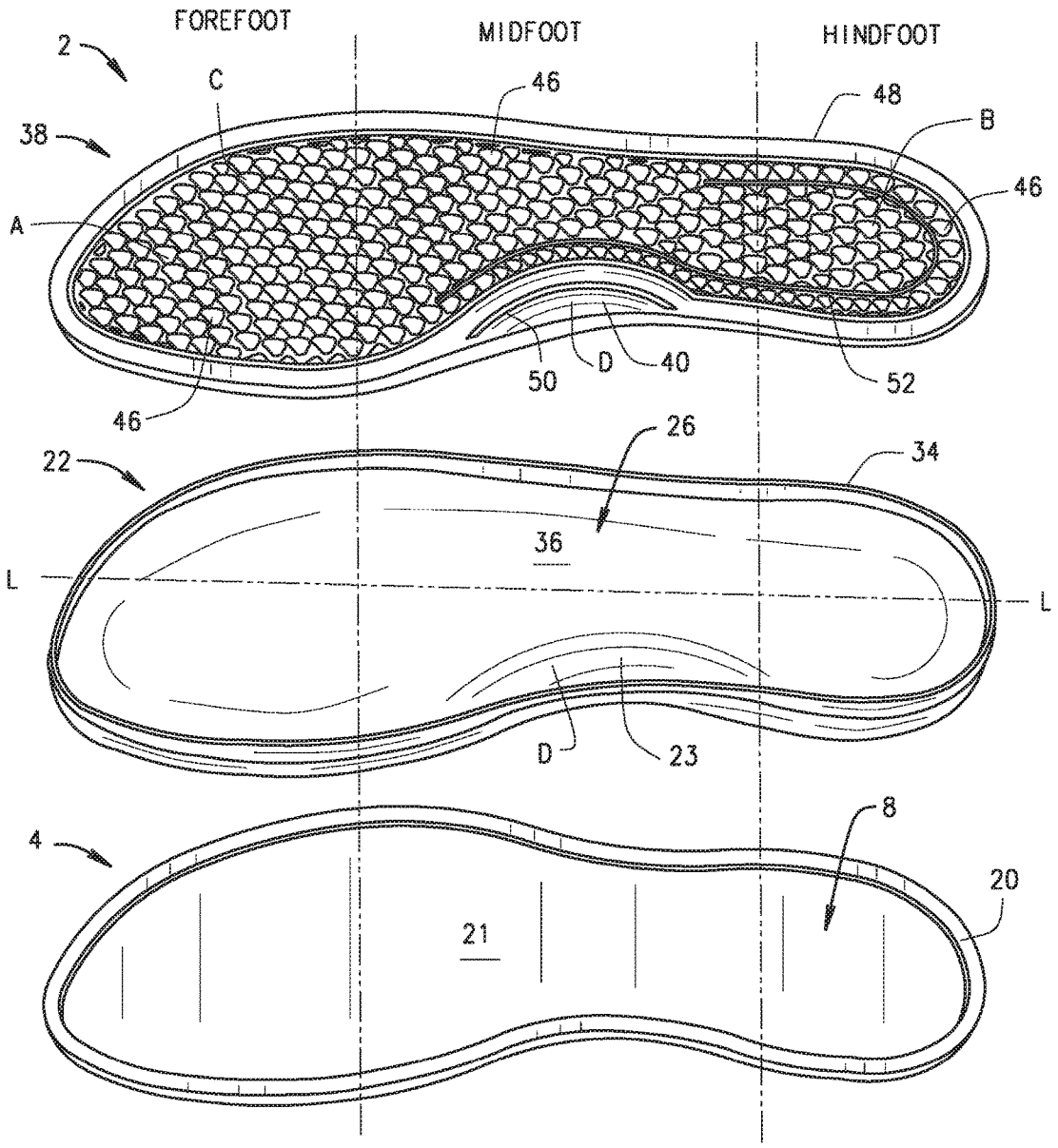
FIG. 1 is an exploded perspective view illustrating a shoe structure constructed according to the teachings of the present invention.

While the disclosure is susceptible to various modifications and alternative forms, specific embodiments thereof are shown by way of example in the drawings and will herein be described in detail. It should be understood, however, that the drawings and detailed description presented herein are not intended to limit the disclosure to the particular embodiment disclosed, but on the contrary, the intention is to cover all modifications, equivalents, and alternatives falling within the spirit and scope of the present disclosure.

DETAILED DESCRIPTION OF THE DRAWINGS

The invention will now be described with reference to the drawing figures in which like reference numerals refer to like parts throughout. For purposes of clarity in illustrating the characteristics of the present invention, proportional relationships of the elements have not necessarily been maintained in the drawing figures.

As illustrated in FIG. 1, a three layer shoe construction 2 constructed in accordance with the teachings of the present invention includes an outsole 4, a midsole 22, and an insole 38. The outsole 4, midsole 22, and insole 38 have a mating relationship to each other as will be hereinafter further described. The combination of the three layers provides a unique cushioning and energizing propulsion effect, giving the wearer a sense of bouncing off of the ground. The layers of the present shoe are preferably secured together in a conventional manner such as through cementing and/or adhesives thereby preventing relative movement between the layers during assembly and use of the present shoe.

Each of the three layers of the present shoe are generally in the shape of a human foot and can be divided into different sections according to three distinct regions of the human foot—the forefoot, midfoot, and hind foot. The forefoot area or region of the foot is approximately adjacent to and includes the toe area A, while the hind foot area or region of the foot is approximately adjacent to and includes the heel area B. The midfoot area or region is approximately adjacent to both the forefoot and hind foot regions as illustrated in FIG. 1 and includes the arch D. The ball area C of the foot is generally the area of the foot at the juncture between the metatarsal bones and the phalange bones. The two primary regions of the foot for load bearing when walking or standing normally includes the ball area C and the heel area B, and the major bending of the shoe during normal use is typically in the vicinity of the ball area C. The arch or instep area D is located between the heel area B and ball area C, and flexes very little when walking normally. The three layers of the present shoe also includes a longitudinal axis L which extends through the forefoot, midfoot and hind foot areas and can further be divided into a proximal and distal half (the proximal half and the distal half being a medial half and a lateral half, respectively). The proximal half is located on the side of the longitudinal axis L that includes the arch area D, while the distal half is located on the other side of the longitudinal axis L.

Figure 2:
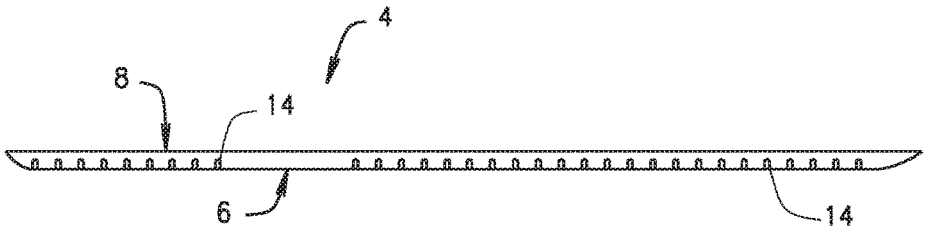
FIG. 2 is a side elevation view of the outsole of FIG. 1.
Figure 3:
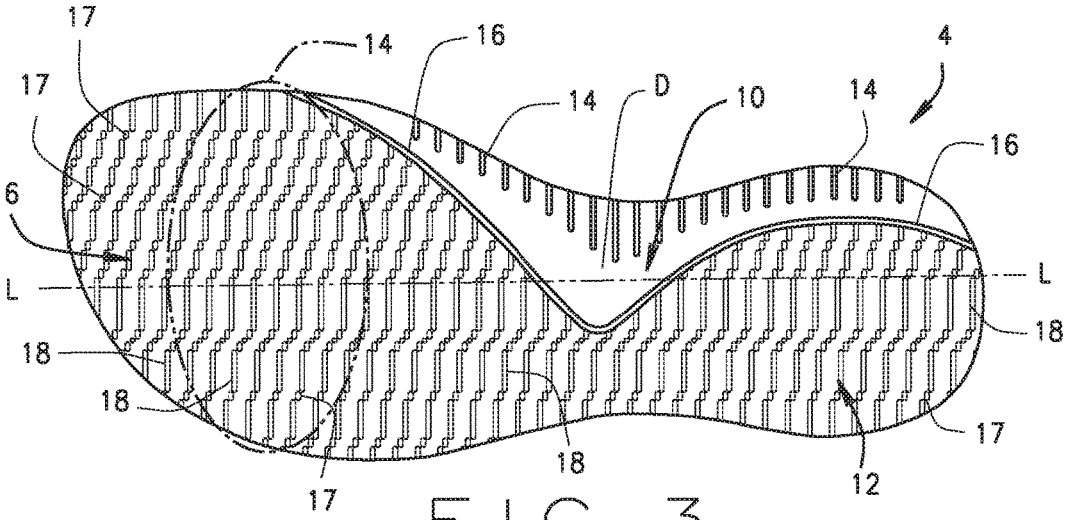
FIG. 3 is a bottom plan view of the outsole of FIGS. 1 and 2.
Figure 4:
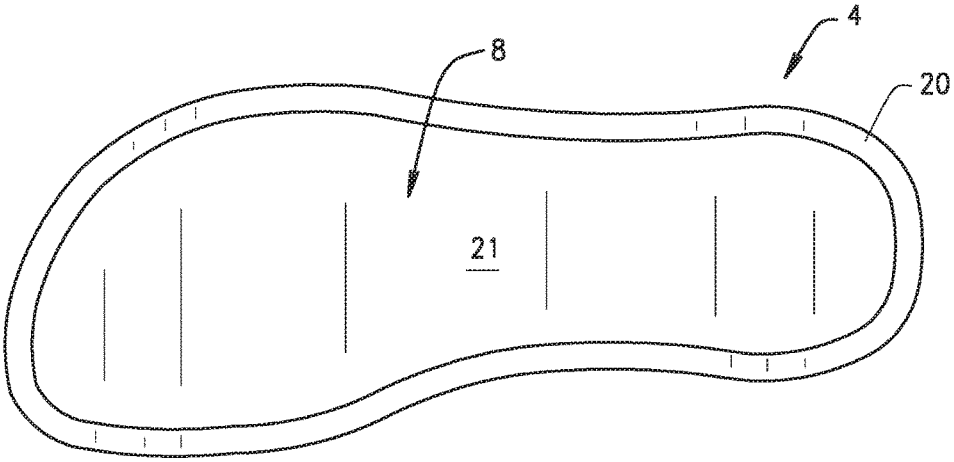
FIG. 4 is a top plan view of the outsole of FIGS. 1, 2, and 3.

The present outsole 4 is made out of a super lightweight thermoplastic rubber (TPR) and has an exterior face 6 and an interior face 8 as seen in FIGS. 2-4. The exterior face 6 of the outsole 4 engages with the ground or other walking surfaces, while the interior face 8 has a mating relationship with the midsole 22 as will be hereinafter described in more detail.

Figure 7:
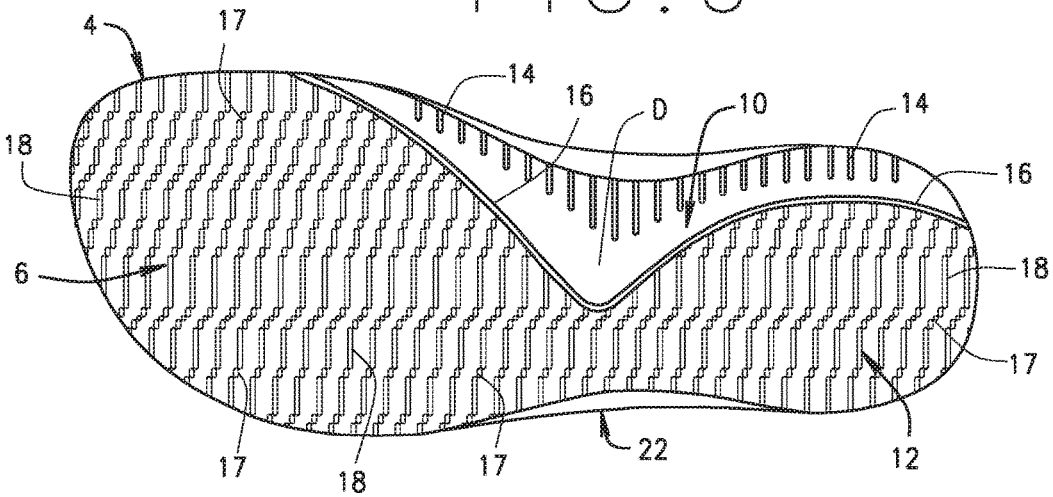
FIG. 7 is a bottom plan view of the outsole and midsole of FIGS. 1-6 mated together.

In one embodiment, the exterior face 6 of the outsole 4 has a first section 10 and a second section 12 which extends in the longitudinal direction of the outsole along the longitudinal axis L. The first section 10 includes parts of the forefoot, midfoot, and hind foot areas respectively. More specifically, the first section 10 includes the arch portion D and extends from the arch portion D towards the proximal side (the proximal side being a medial side) of the forefoot area and also extends in an opposite direction towards the proximal side of the hind foot area as best illustrated in FIGS. 3 and 7. The first section 10 further includes a plurality of horizontal grooves 14 in the forefoot, midfoot and hind areas of the first section which provide extra flexibility and comfort to a wearer when the present shoe is worn. The first section 10 is divided from the second section 12 by a non-linear groove 16 which extends from the heel area into a portion of the forefoot area as best shown in FIGS. 3 and 7.

Figure 14:
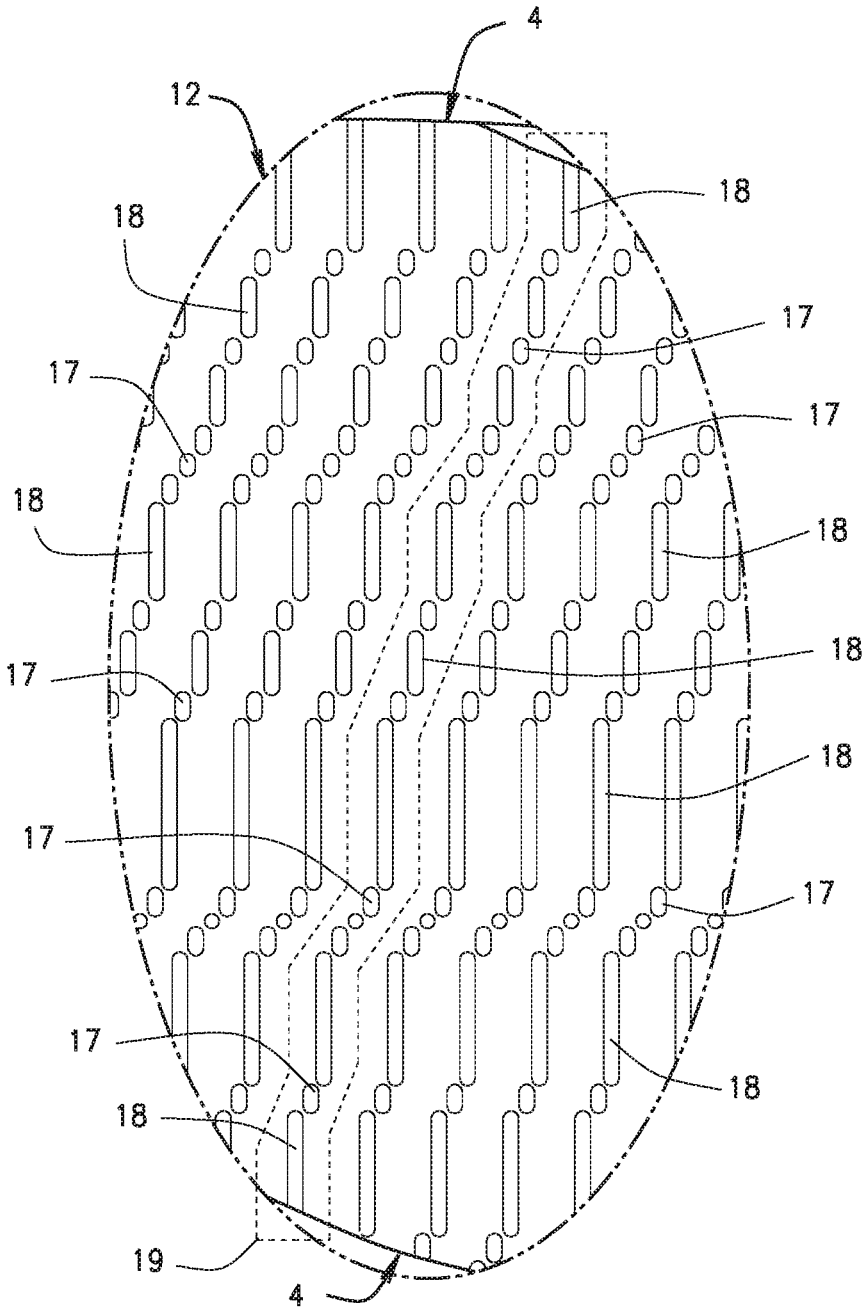
FIG. 14 is a partial exploded view of the aperture pattern on the bottom plan view of the outsole of FIGS. 3 and 7.

The second section 12, on the other hand, includes the remainder of the outsole 4 not covered by the first section 10. In greater detail, the second section 12 includes the majority of the forefoot and hind foot areas and that portion of the midfoot area that is adjacent to the arch portion D as best illustrated in FIGS. 3 and 7. The second section 12 includes a plurality of small and elongated rectangular apertures 17 and 18 as best illustrated in FIG. 14 thereby providing the wearer with additional flexibility and comfort. In one embodiment, the small and elongated apertures 17 and 18 are located and positioned in spaced apart relationship to each other along the longitudinal axis L of the outsole 4 in the second section 12. Here, both the number and spacing of the small apertures 17 in between the elongated apertures 18 may vary as each line of the pattern extends somewhat horizontally across the outsole. For example, in the one embodiment illustrated in FIG. 14, each slightly slanted horizontal line of apertures 19 which extends transversely to the longitudinal axis L of the outsole 4 includes a pattern starting from the distal side of the outsole (the lateral side being a lateral side) having a larger elongated aperture 18 followed by a small aperture 17 followed by a larger elongated aperture 18 followed by a series of three (3) smaller apertures 17 followed by a larger elongated aperture 18 followed by a smaller aperture 17 followed by a somewhat larger aperture 18 followed by a smaller aperture 17 followed by a larger elongated aperture 18 followed by a series of three (3) smaller apertures 17 followed by a somewhat larger aperture 18 followed by a smaller aperture 17 followed by a somewhat larger aperture 18 followed by a smaller aperture 17 followed by a larger aperture 18. At least a portion of this pattern is repeated at each vertically spaced row of small and large apertures across the second section 12 of the outsole 4. Stated differently, this pattern can also be defined by a series of vertically oriented columns of apertures which extend parallel to the longitudinal axis L of the outsole 4 in a pattern which includes, for example, following line 19 of FIG. 14, a column of larger elongated apertures 18 followed by a column of small apertures 17 followed by column of larger elongated apertures 18 followed by a column of three (3) smaller apertures 17 followed by a column of larger elongated apertures 18 and so forth along the line 19 in FIG. 14.

Regardless of the number and/or spacing between the smaller apertures 17 and the larger apertures 18, the intermingling of the small and larger elongated apertures 17 and 18 both horizontally and vertically as illustrated in FIGS. 3, 7 and more importantly FIG. 14 improves the flexibility and cushioning of the outsole 4.

Turning to FIG. 4, the interior face 8 of the outsole 4 has a lip 20 surrounding its entire circumference thereby creating a first cavity 21 substantially in the same shape as the outsole 4. The outsole 4 has a mating relationship with the midsole 22 which will be hereinafter explained. The remainder of the interior face 8 of the outsole 4 is substantially smooth.

Figure 8:
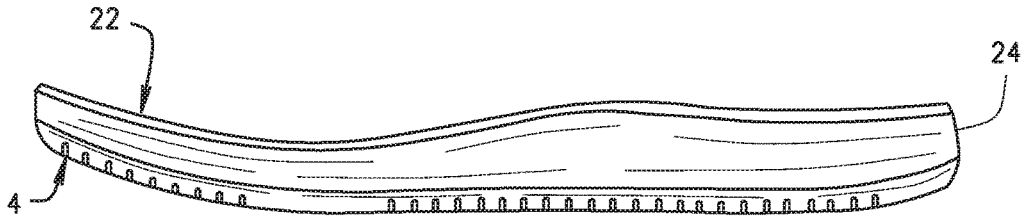
FIG. 8 is side elevation view of the outsole and midsole of FIG. 7 mated together.
Figure 9:
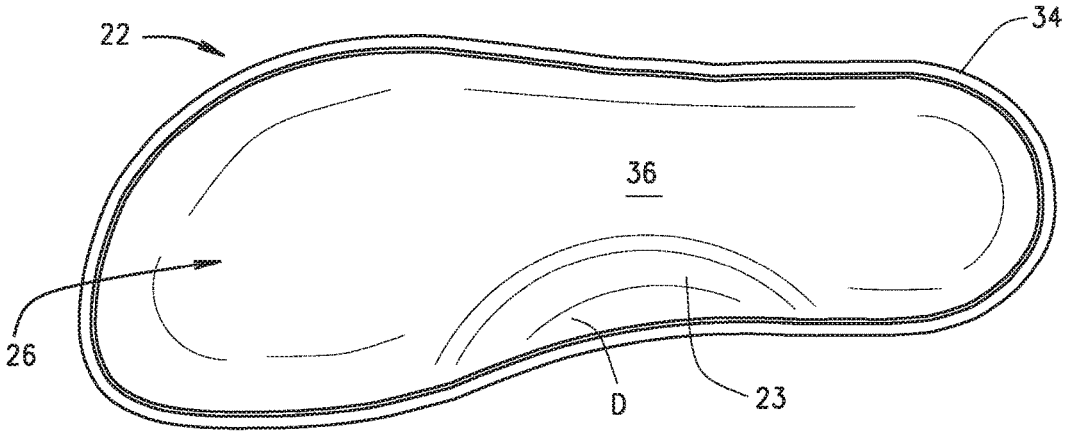
FIG. 9 is a top plan view of the midsole of FIGS. 1, 5, and 6.

The present midsole 22 is made of a dual density blown ethylene-vinyl acetate copolymer (EVA) with an intrinsic molded arch support 23 which supports the arch area D of the foot, as best illustrated in FIGS. 1 and 9. The EVA creates a lightweight and resilient midsole 22 which helps dissipate shock when walking or running. In addition to the material itself, the dual density of the midsole 22 allows for greater flexibility and cushioning in the forefoot area due to its lighter density, and provides greater support and stability in the hind foot area due to its heavier density. The sidewall 24 of the midsole 22 is substantially smooth as best shown in FIGS. 1, 5, and 8.

Figure 5:
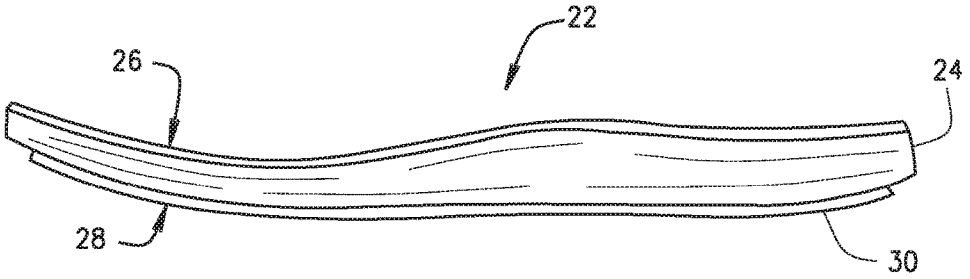
FIG. 5 is a side elevation view of the midsole of FIG. 1.
Figure 6:
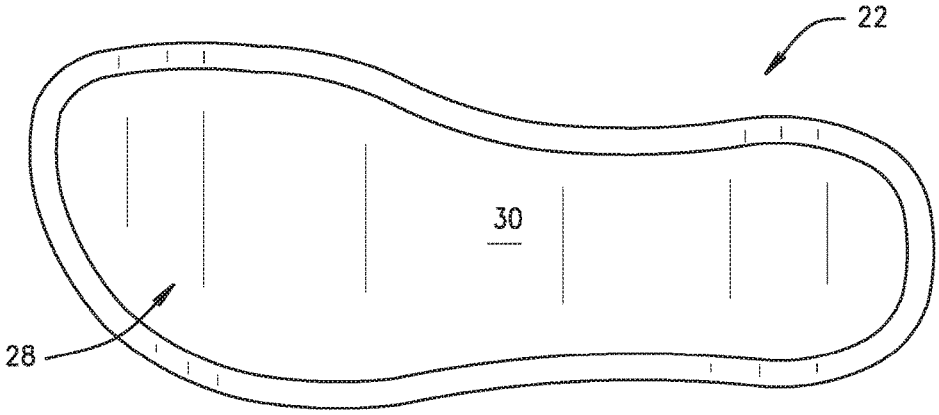
FIG. 6 is bottom plan view of the midsole of FIGS. 1 and 5.
Figure 10:
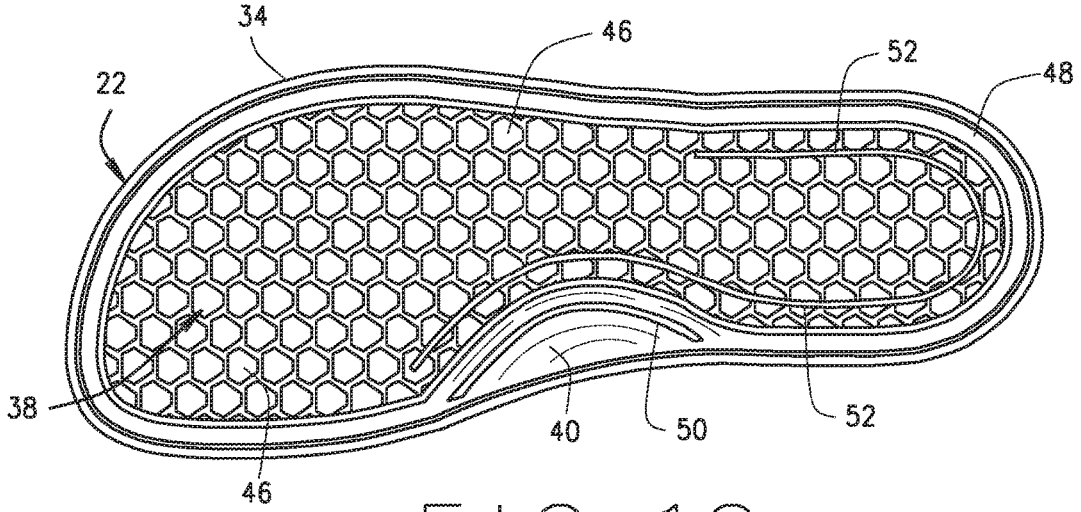
FIG. 10 is a top plan view of the midsole and insole of FIGS. 1, 5, and 9 mated together.

Referring to FIG. 5, the midsole 22 has a proximal face 26 and distal face 28. The distal face 28 has a protrusion or raised area 30 substantially in the shape of the outsole 4 which corresponds to the first cavity 21 in the outsole 4. The midsole 22 has a mating relationship with the outsole 4 wherein the protrusion 30 on the distal face 28 of the midsole 22 mates with and is received by the first cavity 21 created by the lip 20 on the interior face 8 of the outsole 4 as best illustrated in FIGS. 7 and 8. The insole 38 also has a mating relationship to the midsole 22 wherein the proximal face 26 of the midsole 22 has a lip or flange 34 extending around its entire circumference creating a second cavity 36 substantially in the shape of the insole 38 as shown in FIG. 9. Turning to FIG. 10, the insole 38 mates with and is received by the second cavity 36 of the midsole 22. The three layers are preferably secured together to prevent movement when worn.

Figure 11:
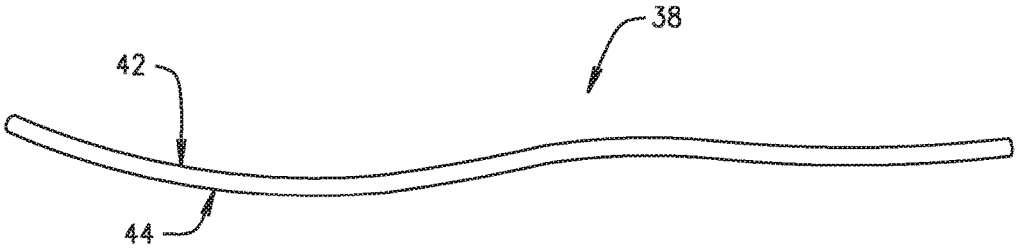
FIG. 11 is a side elevation view of the insole of FIG. 1.
Figure 12:
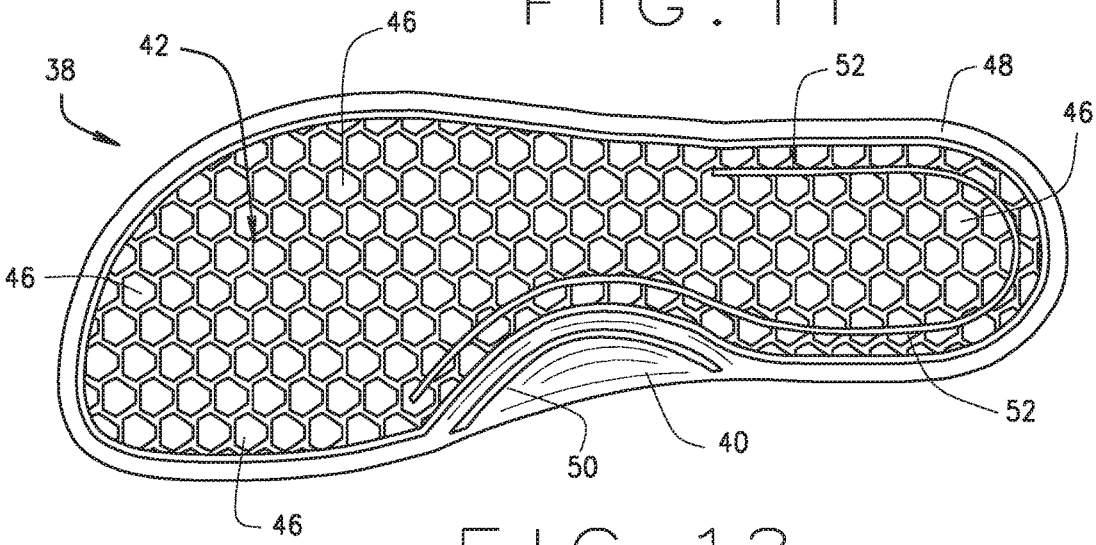
FIG. 12 is a top plan view of the insole of FIGS. 1 and 11.
Figure 13:
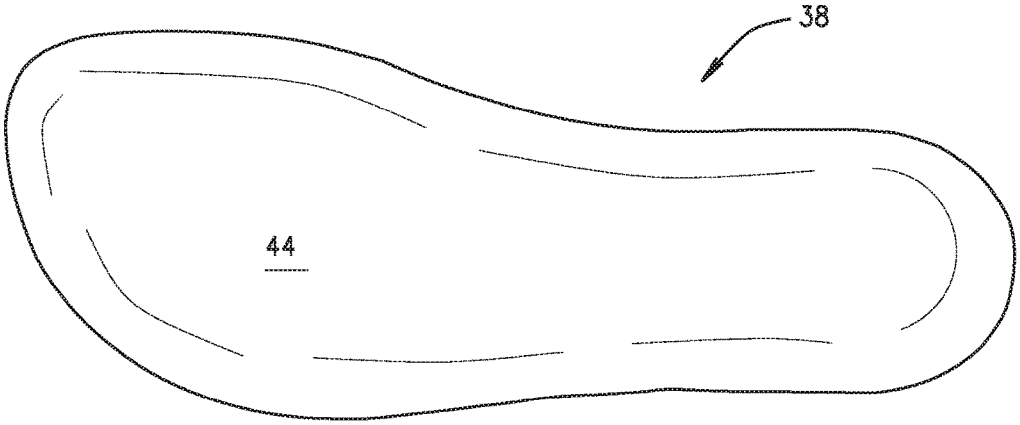
FIG. 13 is a bottom plan view of the insole of FIGS. 1, 11, and 12.

The insole 38 is a lightweight, thermal molded EVA with a molded arch 40 for additional arch support as best illustrated in FIGS. 1, 10, and 12. The insole 38 also has an antimicrobial shield which provides protection against bacteria, fungus, and controls or eliminates odors, stains, and product deterioration. This can be accomplished by adding a powder or other antimicrobial agents during the manufacturing process. As shown in FIGS. 11 and 12, the insole has a top face 42 and a bottom face 44 wherein the top face 42 engages with the foot of a wearer and has a plurality of raised hexagonal shaped projections 46 that provide for a bubble type effect which enhances cushioning and air circulation when the shoe is worn. In one embodiment, the raised hexagon projections 46 cover the entire top face 42 of the insole 38 except for the outer perimeter 48 of the top face 42 of the insole 38 and approximately the proximal half of the arch portion 40 which creates a distinctive bubble type pattern as best illustrated in FIGS. 1, 10, and 12. The proximal half of the arch portion 40 is smooth except for a U-shaped groove 50 which follows the curve of the arch portion 40. The top face 42 has a second groove 52 on the distal half of the arch portion 40 wherein the second groove 52 follows the shape of the U-shaped groove 50, but extends into the hind foot area and around the heel area. Turning to FIG. 13, the bottom face 44 of the insole is substantially smooth.

The present three layer shoe construction absorbs shock, enhances comfort, and creates a unique propulsion effect, without requiring a vast number of components.

From the foregoing, it will be seen that the various embodiments of the present invention are well adapted to attain all the objectives and advantages hereinabove set forth together with still other advantages which are obvious and which are inherent to the present structures. It will be understood that certain features and sub-combinations of the present embodiments are of utility and may be employed without reference to other features and sub-combinations. Since many possible embodiments of the present invention may be made without departing from the spirit and scope of the present invention, it is also to be understood that all disclosures herein set forth or illustrated in the accompanying drawings are to be interpreted as illustrative only and not limiting. The various constructions described above and illustrated in the drawings are presented by way of example only and are not intended to limit the concepts, principles and scope of the present invention.

Many changes, modifications, variations and other uses and applications of the present invention will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A shoe construction comprising:

an outsole having an exterior face, an interior face, a medial side, a lateral side, an arch portion, a forefoot area, a midfoot area, and a hind foot area, the exterior face of the outsole including a first section and a second section, the first section being located and positioned at the arch portion of the outsole and extending into and towards the medial side of both the forefoot area and the hind foot area, the second section being located and positioned adjacent to the first section and extending into the forefoot and hind foot areas and into a portion of the midfoot area adjacent to the arch portion, the first section including a plurality of horizontal grooves and the second section includes a plurality of small apertures and a plurality of elongated apertures, the outsole having a first cavity located and positioned on the outsole's interior face;

a midsole having a proximal face, a distal face, a forefoot area, a midfoot area and a hind foot area, the midsole having a first density in the forefoot area and a second density in the hind foot area, the midsole having a projected area located and positioned on the midsole's distal face and a second cavity located and positioned on the midsole's proximal face; and an insole having a top face, a bottom face, an outer perimeter, a heel portion, an arch portion, a hind foot area, a medial side, and a lateral side, the top face of the insole including a plurality of raised projections, the outer perimeter and a medial half of the arch portion being substantially smooth;

the first cavity on the interior face of the outsole being shaped and dimensioned to receive the projected area on the distal face of the midsole and the second cavity on the proximal face of the midsole being shaped and dimensioned to receive the insole.

2. The shoe construction of claim 1 wherein the midsole includes a molded arch support.

3. The shoe construction of claim 1 wherein the plurality of raised projections on the top face of the insole includes a plurality of raised hexagonal shaped projections.

4. The shoe construction of claim 1 wherein the medial half of the arch portion of the insole includes a U-shaped groove which follows a curve of the arch portion.

5. The shoe construction of claim 4 wherein the top face of the insole includes a second groove located and positioned on a lateral half of the arch portion wherein the second groove follows the curve of the U-shaped groove and extends into the hind foot area and around the heel area.

6. The shoe construction of claim 1 wherein the first section is divided from the second section by a non-linear groove.

7. The shoe construction of claim 1 wherein the outsole has a longitudinal axis, the plurality of small apertures and the plurality of elongated apertures being located and positioned in spaced apart relationship to each other along the longitudinal axis.

8. The shoe construction of claim 1 wherein the midsole has a sidewall which is smooth.

9. The shoe construction of claim 1 wherein the outsole is made of a lightweight thermoplastic rubber.

10. The shoe construction of claim 1 wherein the midsole is made of a dual-density ethylene-vinyl acetate copolymer.

11. The shoe construction of claim 1 wherein the insole is made of a lightweight, thermal molded ethylene-vinyl acetate copolymer.

12. A shoe construction comprising:

an outsole having an exterior face, an interior face, a medial side, a lateral side, an arch portion, a forefoot area, a midfoot area, and a hind foot area, the exterior face of the outsole including a first section and a second section, the first section being located and positioned at the arch portion of the outsole and extending into and towards the medial side of the forefoot area and the hind foot area, the second section being located and positioned adjacent to the first section and extending into the forefoot and hind foot areas and into a portion of the midfoot area adjacent the arch portion, the first section being divided from the second section by a non-linear groove, the first section including a plurality of horizontal grooves and the second section including a plurality of small apertures and a plurality of larger elongated apertures, the outsole having a first cavity located and positioned on the outsoles's interior face;

a midsole having a proximal face, a distal face, a forefoot area, a midfoot area and a hind foot area, the midsole having a first density in the forefoot area and a second density in the hind foot area, the midsole having a projected area located and positioned on the midsole's distal face and a second cavity located and positioned on the midsole's proximal face; and an insole having a top face, a bottom face, an outer perimeter, a heel portion, an arch portion, a hind foot area, a medial side, and a lateral side, the top face of the insole including a plurality of raised projections, the outer perimeter and a medial half of the arch portion being substantially smooth, the medial half of the arch portion including a U-shaped groove wherein the U-shaped groove follows a curve of the arch portion, the top face further including a second groove located and positioned on the distal half of the arch portion wherein the second groove follows the curve of the U-shaped groove and extends into the hind foot area and around the heel area;

the first cavity on the interior face of the outsole being shaped and dimensioned to receive the projected area on the distal face of the midsole and the second cavity on the proximal face of the midsole being shaped and dimensioned to receive the insole.

13. The shoe construction of claim 12 wherein the midsole includes a molded arch support.

14. The shoe construction of claim 12 wherein the plurality of raised projections on the top face of the insole includes a plurality of raised hexagonal shaped projections.

15. The shoe construction of claim 12 wherein the outsole has a longitudinal axis, the plurality of small apertures and the plurality of larger elongated apertures being located and positioned in spaced apart relationship to each other along the longitudinal axis.

16. The shoe construction of claim 12 wherein the midsole has a sidewall which is smooth.

17. A shoe construction comprising:

an outsole having an exterior face, an interior face, a longitudinal axis, a medial side, a lateral side, an arch portion, a forefoot area, a midfoot area, and a hind foot area, the exterior face of the outsole including a first section and a second section, the first section being located and positioned at the arch portion and extending into and towards the medial side of the forefoot area and the hind foot area, the second section being located and positioned adjacent to the first section and extending into the forefoot area, the hind foot area, and a portion of the midfoot-area adjacent to the arch portion, the first section being divided from the second section by a non-linear groove, the first section including a plurality of spaced horizontal grooves and the second section including a plurality of small apertures and a plurality of larger elongated apertures located and positioned in spaced apart relationship to each other along the longitudinal axis, the outsole having a first cavity located and positioned on the outsole's interior face;

a midsole having a proximal face, a distal face, a sidewall, a forefoot area, a midfoot area and a hind foot area, the midsole having a first density in the forefoot area and a second density in the hind foot area, the second density being greater than the first density, the midsole having a projected area located and positioned on the midsole's distal face and a second cavity located and positioned on the midsole's proximal face, the sidewall of the midsole being smooth; and an insole having a top face, a bottom face, an outer perimeter, a heel portion, an arch portion, a hind foot area, a medial side, and a lateral side, the top face of the insole including a plurality of hexagonal shaped raised projections, the outer perimeter and a medial half of the arch portion being substantially smooth, the medial half of the arch portion including a U-shaped groove which follows a curve of the arch portion, the top face further including a second groove located and positioned on a lateral half of the arch portion wherein the second groove follows the curve of the U-shaped groove and extends into the hind foot area and around the heel area;

the first cavity on the interior face of the outsole being shaped and dimensioned to receive the projected area on the distal face of the midsole and the second cavity on the proximal face of the midsole being shaped and dimensioned to receive the insole.

18. The shoe construction of claim 17 wherein the midsole includes a molded arch support.

19. The shoe construction of claim 17 wherein the insole includes an antimicrobial shield.

* * * * *